United States Patent [19]

Wright

[11] 3,945,504

[45] Mar. 23, 1976

[54] ANTI-SWAY SYSTEM FOR A SPREADER SUSPENDED FROM A CRANE

[75] Inventor: Lawrence A. Wright, Alameda, Calif.

[73] Assignee: Fruehauf Corporation

[22] Filed: Mar. 11, 1974

[21] Appl. No.: 449,700

[52] U.S. Cl. ..... 212/14; 254/144; 212/126

[51] Int. Cl.[2] ..... B66C 5/02

[58] Field of Search ..... 212/10–15, 212/126–129; 254/144, 192

[56] References Cited

UNITED STATES PATENTS

| | | | |
|---|---|---|---|
| 3,081,884 | 3/1963 | Minty | 212/14 |
| 3,179,259 | 4/1965 | McLean | 212/14 X |
| 3,476,263 | 11/1969 | Komatsu et al. | 212/14 |
| 3,532,324 | 10/1970 | Crittenden | 212/14 X |
| 3,746,182 | 7/1973 | Tax et al. | 212/14 X |

*Primary Examiner*—Robert J. Spar
*Assistant Examiner*—R. B. Johnson
*Attorney, Agent, or Firm*—Bruce & McCoy

[57] ABSTRACT

An apparatus for arresting the pendulums and rotational sway motion of a suspended load relative to its lifting platform and utilizing a compensated reeving system. Rope drums are mounted on the ends of a shaft which is rotatably secured to a lifting spreader having a load attached thereto. Wire ropes are reelable from the rope drums and are secured at their ends to a feeder reel mounted on the lifting platform. Unreeling of the ropes from the drums due to sway of the load causes work to be done on a brake engaged with the shaft. The feeder reel gathers in and pays out the wire rope as the load is raised and lowered.

4 Claims, 8 Drawing Figures

ANTI-SWAY SYSTEM FOR A SPREADER SUSPENDED FROM A CRANE

BACKGROUND OF THE INVENTION

1. Field of the Invention

The present invention relates generally to an anti-sway system and more particularly to an improved anti-sway system utilizing a compensated reeving system for arresting the pendulum and rotational sway motions of a load suspended from a lifting platform, such as a mobile crane or crane trolley.

A problem commonly encountered in handling cargo by cranes is sway of the load occurring because the cargo must be moved horizontally while suspended by cables. Due to this movement, the cargo experiences pendulum sway motion from the horizontal acceleration and deceleration forces inherent to the movement, and rotational sway motion from the centrifugal forces which occur as a mobile crane is steered in and around the storage area.

Therefore, in order to accurately position the suspended load for set down and release, it is necessary to wait until the pendulum and rotational sway motions have subsided. Thus, in each cargo handling cycle of the crane, considerable time is lost due to such sway. To increase the handling capacity of the crane, it is of primary importance to reduce this time necessary for sway motion abatement.

DESCRIPTION OF THE PRIOR ART

Numerous types of anti-sway devices have been developed for preventing or arresting the pendulum and rotational sway motions of suspended loads.

Two anti-sway devices closely related to the present invention are those disclosed in U.S. Pat. Nos. 3,375,938 and 3,532,324. The present invention is an improvement of the apparatus disclosed in these patents in that it utilizes a compensated reeving system in combination with the anti-sway mechanisms disclosed therein.

Certain significant problems and drawbacks have been encountered in the operation of anti-sway devices of the types disclosed in these patents.

For example, with such conventional devices, a complex spring drive system for the rope rewinding means is required because take-up of the anti-sway ropes must be provided by this means throughout the entire vertical hoist range of the lifting spreader. Correspondingly, the vertical hoist lifting range of the lifting spreader is limited by the capability of the spring drive system used.

In addition, wear on the take-up spring and brake system has proven to be excessive due to the necessity of providing take-up by this means of the anti-sway ropes during lifting of the spreader and drag against the brake while lowering the spreader.

A further operational problem encountered with such conventional systems is that the anti-sway action is not particularly effective during lifting of the load. The reason for this is that when the direction of the load sway corresponds with the direction of the take-up of the rewinding means, the forces thereby created tend to relieve the action of the take-up spring rather than causing the brake to engage. As a result, the sway of the load must be great enough to overhaul the rewinding means, reverse its direction, and set the drum clutch before effective braking occurs to dampen the sway. Hence, it has been found that with the prior art devices the load generally has a tendency to raise in a series of unequal swings without coming to rest as rapidly as desired.

SUMMARY OF THE INVENTION

The present invention is an anti-sway system utilizing a compensated reeving system designed primarily for use on container handling cranes to arrest the pendulum and rotational sway motion of containers when suspended by wire ropes. However, it will be apparent that the present invention may be utilized for arresting sway in a wide variety of suspended loads.

The present invention overcomes the problems and drawbacks encountered with prior art anti-sway devices by providing a compensated reeving system which gathers in and pays out the anti-sway ropes during raising and lowering of the load. In this manner, substantial engagement of the rewinding means and brake system are avoided during such raising and lowering operations, thereby allowing for less complex and expensive spring drive systems, less wear and greater operational life of the take-up spring and brake system, and greater vertical hoist lifting range.

In addition, a more effective anti-sway action is provided during lifting of the load since positive retrieval of the anti-sway rope allows for a nearly static condition of the anti-sway system, which greatly improves the response of the brake in dampening any sway of the load so experienced.

In brief, the invention entails mounting rope drums on a load lifting spreader. Means are engaged with each of said rope drums for rewinding slack in ropes reelable therefrom. Brake means are also engaged with the rope drums for causing work to be done by the ropes when unreeled from the rope drums due to any sway experienced by the lifting spreader. A feeder reel is mounted on the crane lifting platform above the lifting spreader. The ends of the ropes reelable from the rope drums are secured to the feeder reel and a means is provided for driving the feeder reel relative to the vertical position of the lifting spreader. In this manner the anti-sway ropes are gathered in or payed out by the feeder reel as the lifting spreader and attached load are raised or lowered respectively, without causing substantial engagement of the rewinding and brake means.

Other features and advantages are inherent in the invention disclosed and claimed herein, or will become apparent to those skilled in the art from the following detailed description of the preferred embodiment considered in conjunction with the accompanying diagrammatic drawings.

DESCRIPTION OF THE PREFERRED EMBODIMENT

Figure 1:
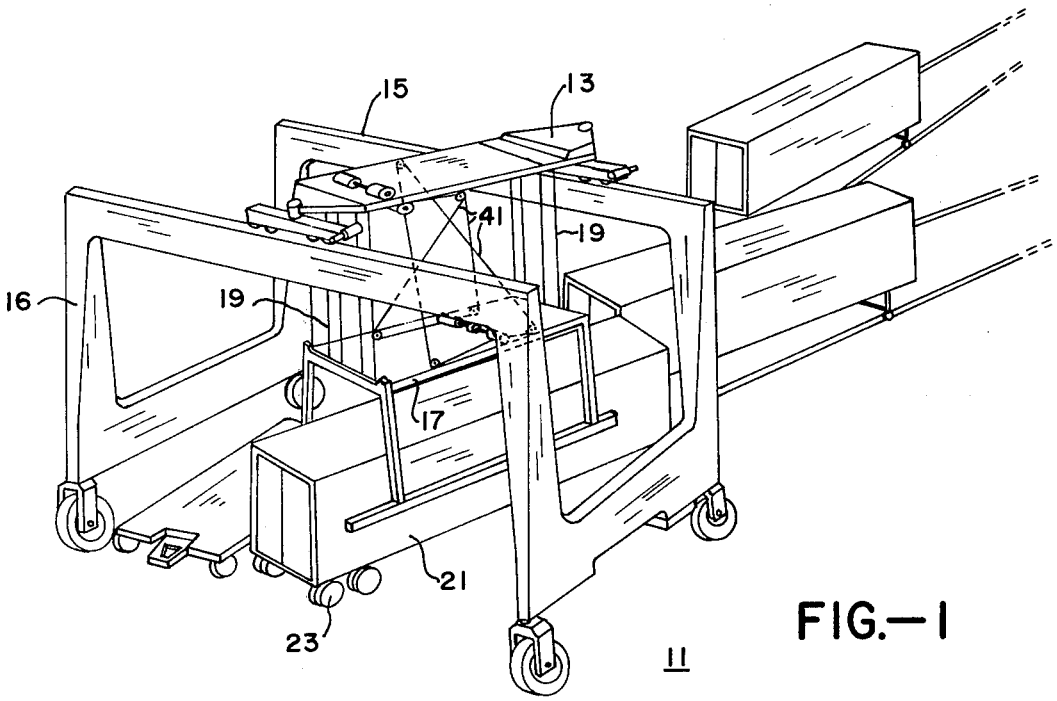
FIG. 1 is a perspective view of a mobile cargo container handling crane having an anti-sway system constructed in accordance with an embodiment of the present invention.

Referring to FIG. 1 of the drawings, there is generally illustrated a mobile cargo handling crane 11 having a lifting platform 13, which may be a movable trolley supported on cross beams 15 of the crane frame 16. A cargo container lifting spreader 17 is suspended by substantially vertically depending wire rope hoist cables 19 below the movable trolley for picking up a load such as cargo containers 21, individually, or truck trailers 23 with containers on them.

When the load is lifted, the crane moves across the ground or dock and the acceleration, deceleration, and centrifugal forces experienced by the suspended load during movement and turning induce pendulum and rotational sway motion.

Figure 2:
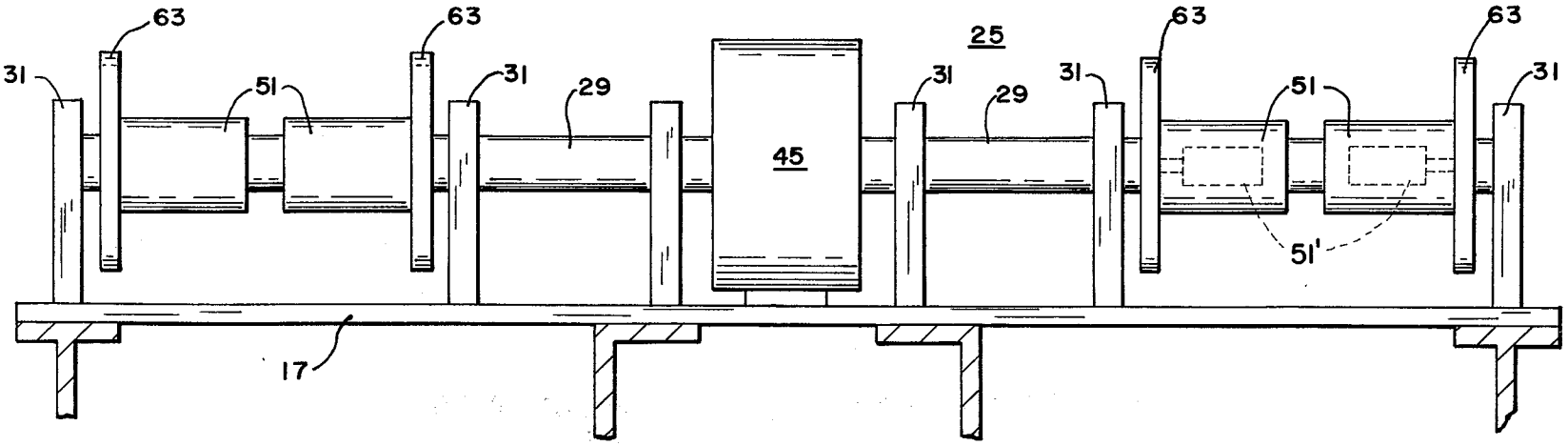
FIG. 2 is a partial side elevation in section of the anti-sway mechanism taken along line 2—2 of FIG. 4.

Referring now to FIG. 2, anti-sway mechanism 25 is shown secured to lifting spreader 17. The apparatus includes shaft 29 which is rotatably secured to the spreader by means of journal bearings 31. A brake means 45 is mounted on the shaft and lifting spreader for causing work to be done when the anti-sway ropes are lengthened due to sway of the load, as will be more fully described below. A large capacity commercially available disc type brake has been found to be particularly effective for use as the braking means in the anti-sway system of the present invention.

Referring now to FIGS. 2–5, two wire rope drums 51 are mounted on each end of the shaft 29 and have wire anti-sway ropes 41 reelable thereform. The wire ropes extend in opposite directions from the drums on the same end of the shaft in such a manner that unreeling of the ropes from any of the drums causes unidirectional rotation of the shaft.

The anti-sway ropes are reeved through direction changing shackle blocks 53 mounted on the lifting spreader 17 along its edge, and, correspondingly, along the edge of the attached load, and at opposite ends thereof. The ropes are then reeved through another set of direction changing shackle blocks 55 mounted on the underside of lifting platform 13 about the center thereof and at the opposite edges of the load from shackle blocks 53. The ends of the ropes are secured to feeder reels 57 which are mounted on the underside of the lifting platform 13 and proximate one end thereof. In the preferred embodiment of the invention illustrated, feeder reels 57 are interconnected by a shaft 59 which may be rotatably secured to the lifting platform by means of journal bearings 61. By reeving from the edges and opposite ends of spreader 17 to the opposite edges of lifting platform 13, as is shown in the drawings, the anti-sway ropes 41 effect the maximum lateral force possible to arrest swaying motion of the suspended load and the spreader.

Each of the drums 51 includes an independent internal clutch means, shown in dotted lines as 51 in FIG. 2, which interconnects each drum with the shaft for rotating the shaft when rope is pulled off any one of the rope drums. The commercially available clutch means are utilized to permit the drums to overrun wherever an anti-sway rope is rewound onto a rope drum.

Rewind means are engaged with drum 51 for taking up slack in ropes 41. This means may include independent pre-wound spring motors 63 which are engaged with each of the drums. The motors rewind the anti-sway ropes on the drums whenever slack occurs therein due to difference in the reeving geometry during lifting of the spreader or during the return sway motion of the suspended load.

Figure 3:
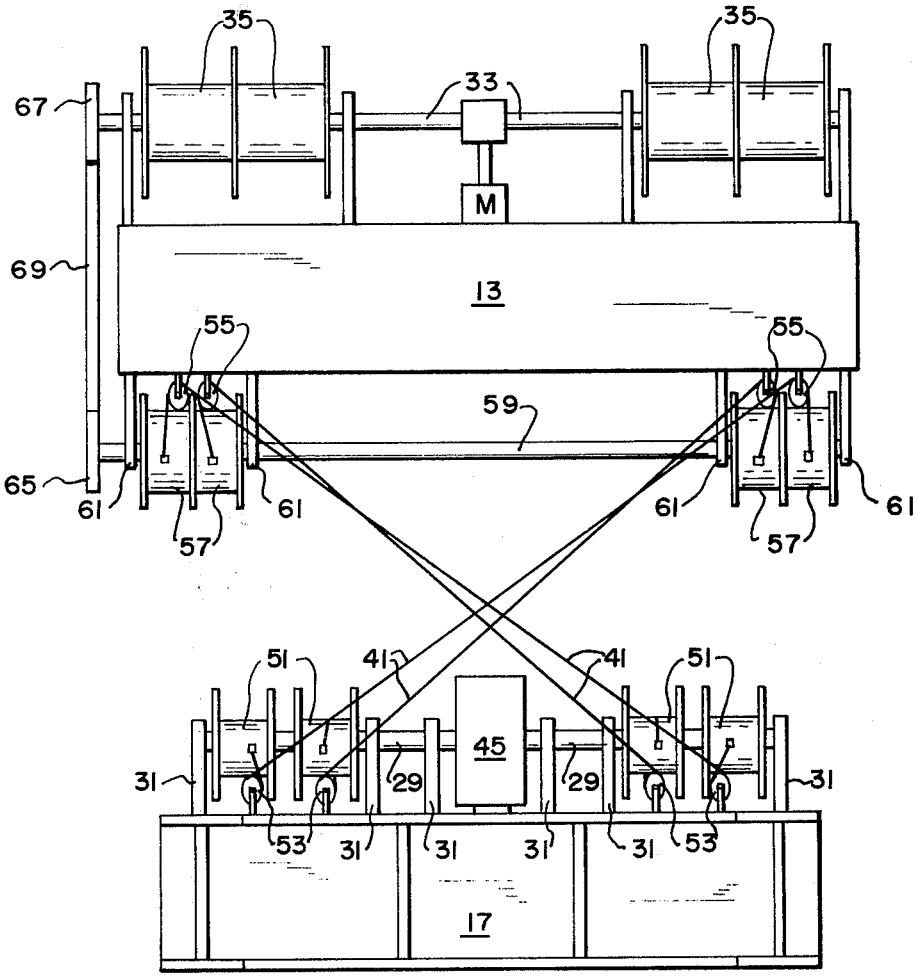
FIG. 3 is an end elevation view of the lifting platform and spreader assembly shown in FIG. 1 illustrating the reeving of the anti-sway ropes of the present invention.
Figure 4:
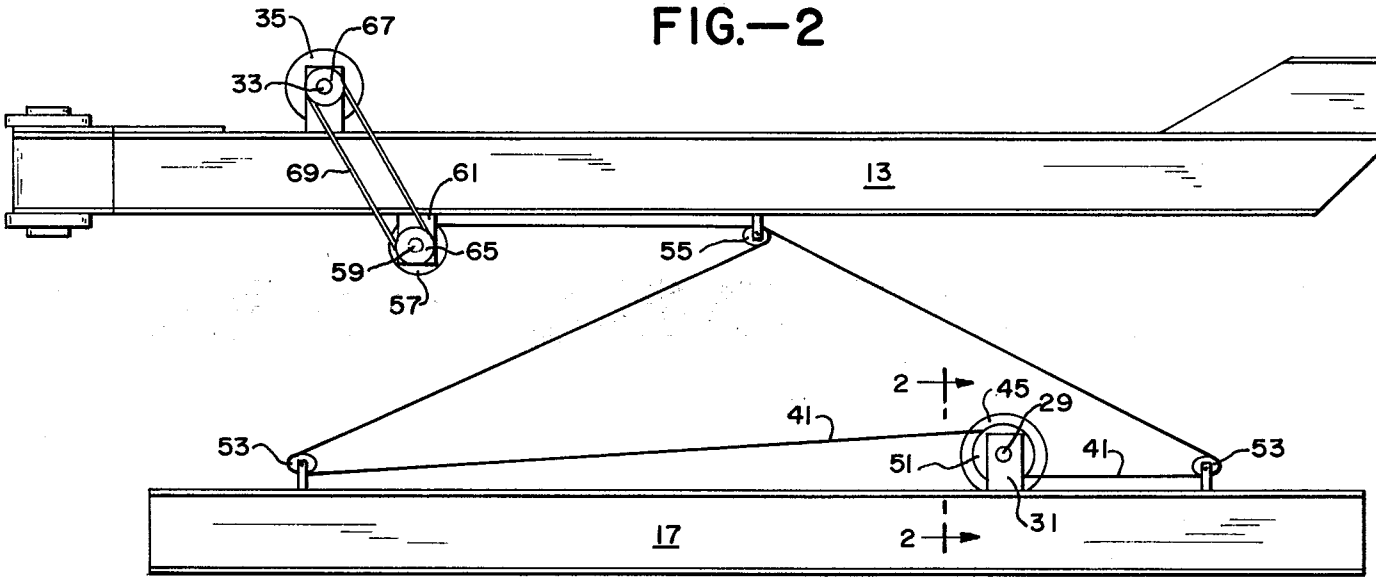
FIG. 4 is a side elevation view of FIG. 3.
Figure 5:
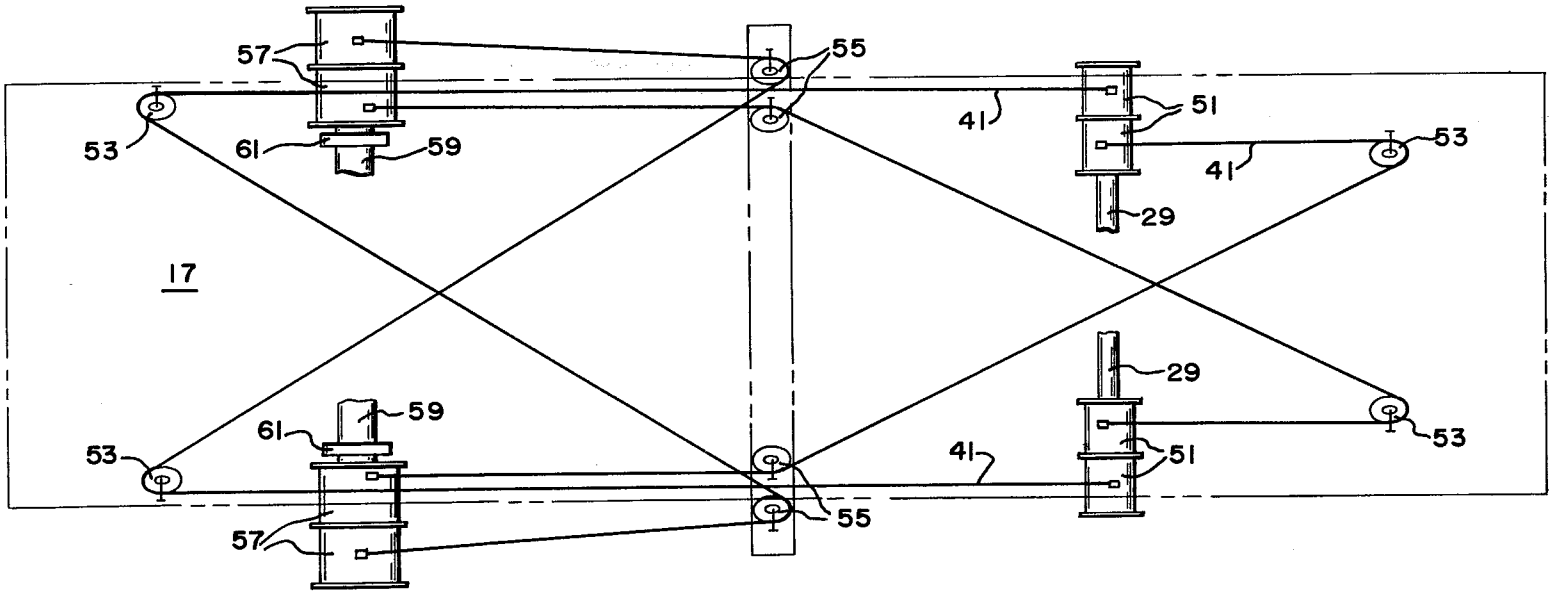
FIG. 5 is a partial top schematic view of the lifting platform and spreader assembly of FIG. 3 illustrating the reeving of the anti-sway ropes of the present invention.

A means for driving feeder reel 57 relative to the vertical position of the lifting spreader 17 is shown in FIGS. 3 and 4. Chain sprockets 65 and 67 are mounted respectively on the ends of feeder reel shaft 59 and hoist shaft 33 which is mounted on the top side of lifting platform 13. Hoist drums 35 are secured to hoist shaft 33. A roller chain 69 interconnects chain sprockets 65 and 67.

Therefore, as hoist drums 35 are rotated to raise or lower lifting spreader 17 by vertically depending hoist cables 19, feeder reels 57 are caused to revolve to retrieve or pay out anti-sway ropes 41. The ratio of rotation between the hoist drums and feeder reels is selected to average the amount of anti-sway rope gathered in and payed out throughout the hoist lift range, so that substantial engagement of the anti-sway mechanism may be avoided, thereby minimizing the amount of spring take-up and brake drag. For example, with the prior art anti-sway device described above, the spring take-up was required to provide for up to 25 revolutions of anti-sway mechanism drums 51 during lift of the spreader over a typical range. However, with the present invention, only one or two revolutions are necessary over the same lift range in order to accommodate differences in the reeving geometry between the anti-sway ropes and the hoist ropes.

Figure 6:
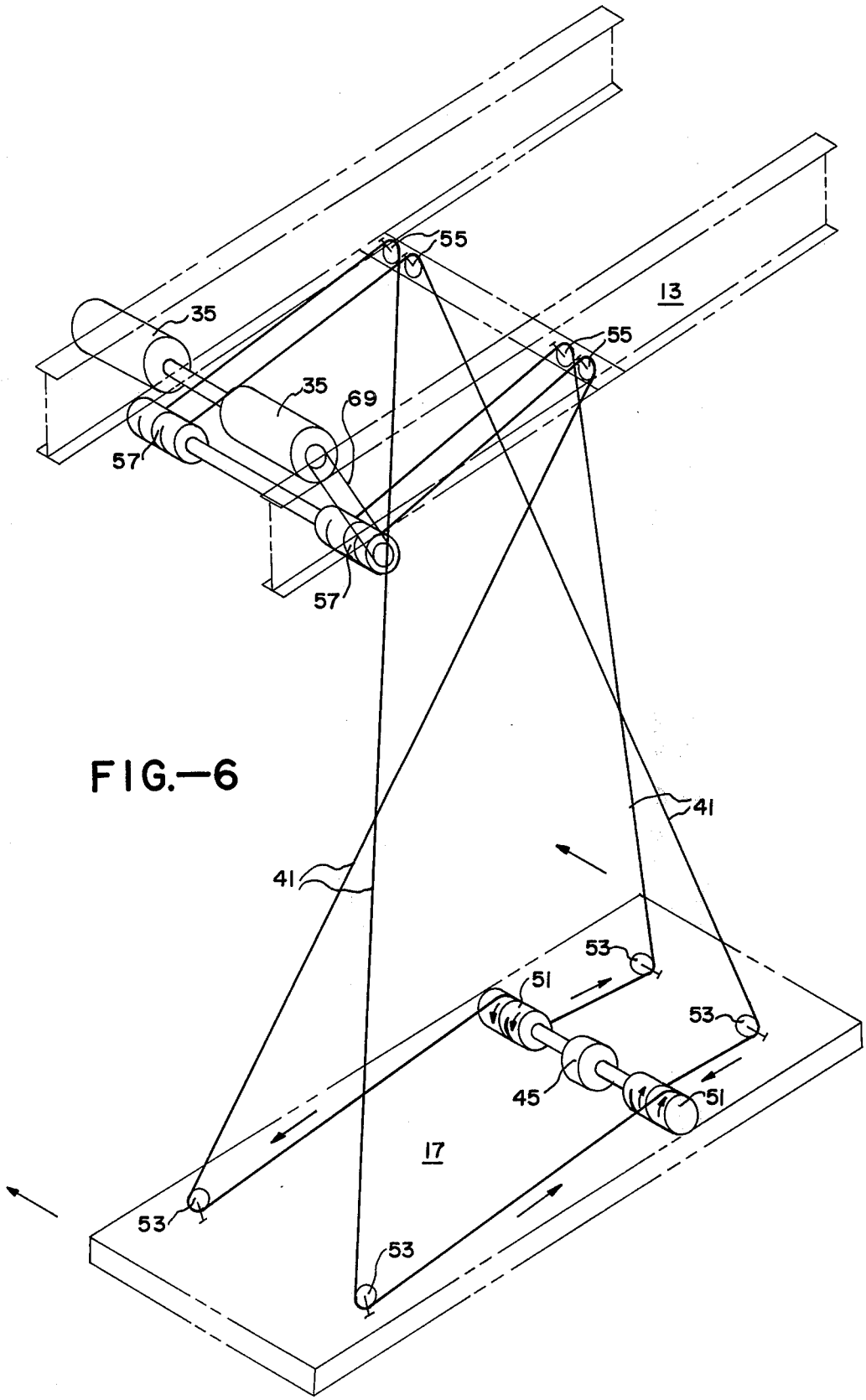
FIG. 6 is a schematic prespective view of the present invention showing a suspended load moving with a pendulum sway motion in a lateral direction.
Figure 7:
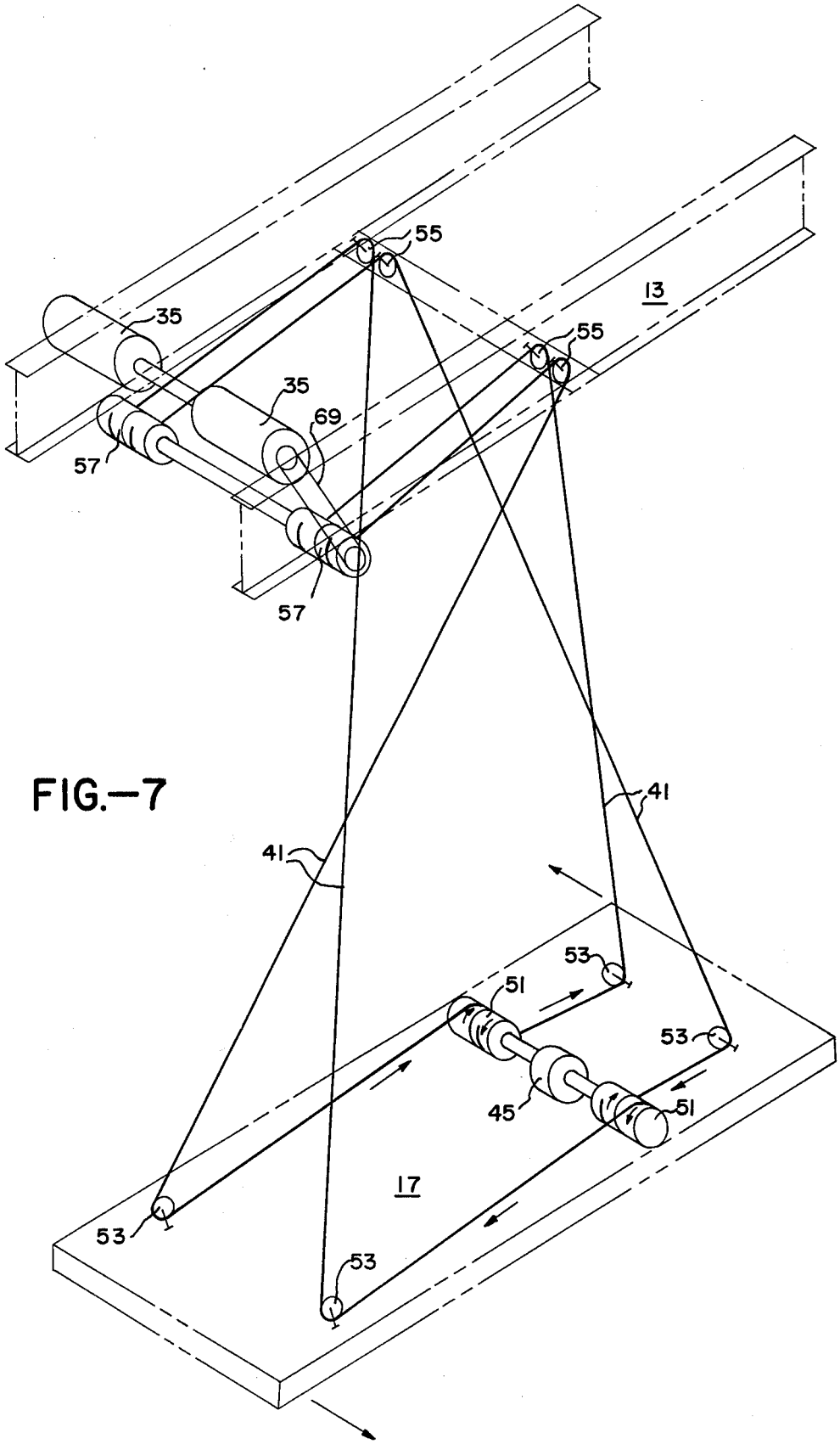
FIG. 7 is a schematic perspective view similar to FIG. 6 showing the suspended load moving with a rotational sway motion in a counterclockwise direction.
Figure 8:
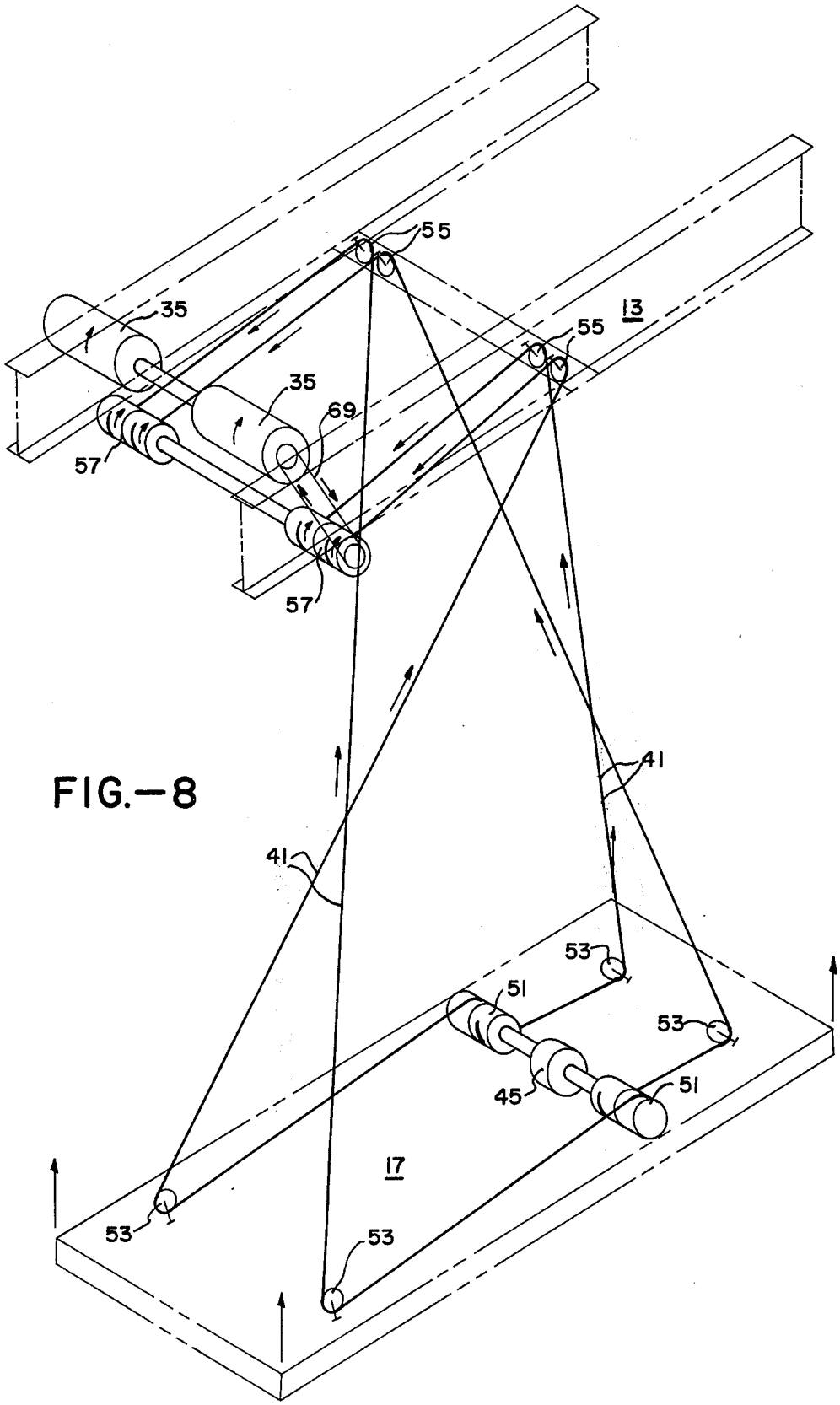
FIG. 8 is a schematic perspective view similar to FIG. 6 showing the suspended load being raised.

FIGS. 6–8 illustrate the operation of the anti-sway system in a variety of sway motion situations. The arrows show the direction of sway motion of the lifting spreader 17 and attached load, the direction of movement of the anti-sway ropes 41, and the direction of rotation of drum 35, 51 and 57.

FIG. 6 shows spreader 17 moving with a pendulum sway motion in a lateral direction. Sway-arrest ropes 41 are pulled from the two lower drums 51 by the sway of the spreader toward the upper left. The unidirectional clutches engage the shaft and cause work to be done on brake 45 which, in turn, arrests the unreeling of the ropes from the drums. Concurrently, the upper drums 51 are overrunning their unidirectional clutches and the ropes attached to these drums are rewound by the pre-wound spring motors.

FIG. 7 shows spreader 17 moving with a counterclockwise rotational sway motion. The pairs of drums 51 at each end of the shaft are turning in opposite directions, one rewinding and the other unreeling. Brake 45 applies an arresting force through the unidirectional clutches to the ropes at opposite ends of the shaft being pulled from the drums. From the operation of the sway-arrest mechanism as is illustrated in FIGS. 6 and 7, it can be seen that any combination of sway motions of the spreader, including silultaneous pendulum and rotational sway motion, will be arrested whenever the sway is great enough to pull rope from a drum, since whenever this occurs, work must be done on the brake.

FIG. 8 shows spreader 17 being lifted by hoist drums 35 through vertically depending wire rope hoist cables attached to the spreader (for clarity the hoist cables are not shown in FIG. 8 but are shown in FIG. 1). Drums 51 remain substantially stationary as feeder reels 57 retrieve anti-sway ropes 41. Feeder reels 57 are revolved at a predetermined rate by hoist drums 35 through interconnecting roller chain 69. It is to be noted that the embodiment of the invention illustrated above provides an added advantage in that special machinery is not necessary to drive the feeder reels since they are powered in a simple manner by the existing hoist drums 35 and motor M.

The foregoing detailed description and example have been given for clearness of understanding alone, and no unnecessary limitations should be understood therefrom as modifications will be obvious to those skilled in the art.

What is claimed is:

1. In an anti-sway system for arresting the sway motion of a load and load lifting spreader suspended by separate rope hoist cables from the lifting platform of a traveling crane wherein said sway motion is arrested by means of anti-sway ropes which are freely gathered in and payed out when the load is vertically raised or lowered by said separate rope hoist cables, but which causes work to be done when the load is set into a sway motion, the improvement comprising:

a shaft rotatably secured to said lifting spreader, rope drums mounted on said shaft having said anti-sway ropes reelable therefrom, a clutch means engaged with each of said rope drums for rotating the shaft when the rope is unreeled from said drums and for overrunning the shaft when the rope is rewound onto said drums, means engaged with said rope drums for rewinding slack which occurs in the anti-sway ropes due to changes in reeving geometry during the return sway motion of the suspended load, but which is not required to gather in and pay out rope when the load is vertically raised or lowered, means engaged with said shaft for causing work to be done by said ropes when unreeled from said rope drums due to the sway of the load, feeder reels mounted on said lifting platform with one end of said anti-sway ropes secured thereto; and means for interconnecting said feeder reels to the vertical hoist means of said traveling crane for driving said feeder reels relative to the vertical position of said lifting spreader whereby said ropes are gathered in or payed out by said feeder reels as the lifting spreader and attached load are raised or lowered respectively, without causing substantial engagement of said rewinding and work causing means.

2. The anti-sway system of claim 1 including two rope drums mounted on each end of said shaft and said work causing means is engaged with said shaft.

3. The anti-sway system of claim 2 including a plurality of sets of rope direction changing shackle blocks, said ropes being reeved from each of the drums at said shaft ends through a first set of said direction changing shackle blocks mounted on said spreader proximate the edges of said load and at opposite ends thereof and through a second set of direction changing shackle blocks mounted on said lifting platform proximate the opposite edges of said load and from there to said feeder reel.

4. In an anti-sway system for arresting the sway motion of a load and load lifting spreader suspended by separate rope hoist cables from the lifting platform of a traveling crane wherein said sway motion is arrested by means of anti-sway ropes which are freely gathered in and payed out when the load is vertically raised or lowered by said separate rope hoist cables, but which causes work to be done when the load is set into a swaying motion the improvement comprising a shaft rotatably secured to said lifting spreader, two rope drums mounted on each end of said shaft rotatably secured to said lifting spreader and having ropes reelable therefrom;

a clutch means engaged with each of said drums for rotating the shaft when the rope is unreeled from said drums and for overrunning the shaft when the rope is rewound onto said drums;

means engaged with each of said rope drums for rewinding slack which occurs in the anti-sway ropes due to changes in the reeving geometry during the return sway motion of the supended load, but which is not required to gather in and pay out rope when the load is vertically raised and lowered, means engaged with said shaft for causing work to be done by said ropes when unreeled from said rope drums due to the sway of the load;

feeder reels mounted on said lifting platform with an end of said ropes secured thereto, a plurality of sets of rope direction changing shackle blocks said anti-sway ropes being reeved from each of the drums at said shaft ends through a first set of direction changing shackle blocks mounted on said spreader proximate the edges of said load and at opposite ends thereof and through a second set of direction changing shackle blocks mounted on said lifting platform proximate the opposite edges of said load and from there to said feeder reels, and means for interconnecting said feeder reel to the vertical hoist means of said traveling crane for driving said feeder reels relative to the vertical portion of said lifting spreader whereby said ropes are gathered in or payed out by said feeder reels as the lifting spreader and attached load are raised or lowered respectively, without causing substantial engagement of said rewinding and work causing means.

* * * * *